United States Patent [19]

Lundell

[11] Patent Number: 4,960,247

[45] Date of Patent: Oct. 2, 1990

[54] COMPOST SHREDDER

[76] Inventor: Vernon J. Lundell, Box 171, Cherokee, Iowa 51012

[21] Appl. No.: 336,434

[22] Filed: Apr. 11, 1989

[51] Int. Cl.[5] ..... B02C 13/04

[52] U.S. Cl. ..... 241/188 R; 241/193; 241/285 A

[58] Field of Search ..... 241/186 R, 188 R, 189 R, 241/193, 195, 285 A

[56] References Cited

U.S. PATENT DOCUMENTS

| | | | |
|---|---|---|---|
| 551,097 | 12/1895 | Russell | 241/188 R |
| 3,025,067 | 3/1962 | Raney et al. | 241/193 X |
| 3,136,556 | 6/1964 | Wilkes et al. | 241/193 X |
| 3,360,207 | 12/1967 | Shetton, Jr. | 241/285 A |

FOREIGN PATENT DOCUMENTS

| | | | |
|---|---|---|---|
| 0005049 | 1/1977 | Japan | 241/188 R |

*Primary Examiner*—Timothy V. Eley

*Attorney, Agent, or Firm*—Fleit, Jacobson, Cohn, Price, Holman & Stern

[57] ABSTRACT

A shredder specifically adapted for use in shredding compost, trash and similar material and includes a generally cylindrical shredding cylinder receiving compost adjacent one end thereof and discharging shredded compost adjacent the opposite end with the cylinder including a plurality of grate bars mounted on the inner surface thereof which coact with a high speed rotary drum or shaft having a plurality of hammers pivotally mounted thereon. Each of the hammers includes a straight shank and twisted end portion which effectively shreds compost due to the close relationship between the ends of the hammers and the grate bars during rotation of the drum or shaft with the twist on the ends of the hammers causing spiral and longitudinal movement of the compost material through the shredder. The outlet for the shredding cylinder is provided with a control plate to vary the size of the opening to determine the rate of movement of the compost material through the shredder thereby determining the characteristics of the shredded compost discharged from the cylinder onto a conveyor device.

14 Claims, 2 Drawing Sheets

COMPOST SHREDDER

BACKGROUND OF THE INVENTION

1. FIELD OF THE INVENTION

The present invention is a shredder specifically adapted for use in shredding compost, trash and similar material and includes a generally cylindrical shredding cylinder receiving compost adjacent one end thereof and discharging shredded compost adjacent the opposite end with the cylinder including a plurality of grate bars mounted on the inner surface thereof which coact with a high speed rotary drum or shaft having a plurality of hammers pivotally mounted thereon. Each of the hammers includes a straight shank and twisted end portion which effectively shreds compost due to the close relationship between the ends of the hammers and the grate bars during rotation of the drum or shaft with the twist on the ends of the hammers causing spiral and longitudinal movement of the compost material through the shredder. The outlet for the shredding cylinder is provided with a control plate to vary the size of the opening to determine the rate of movement of the compost material through the shredder thereby determining the characteristics of the shredded compost discharged from the cylinder onto a conveyor device.

INFORMATION DISCLOSURE STATEMENT

Various devices have been provided for grinding, shredding and otherwise reducing the size of various items. Hammermills for this purpose usually include a housing structure with an inlet and an outlet and a rotating shaft having hammers pivotally mounted thereon which impact against material to break the material, shred it, grind it and the like. Devices of this type which are known find utility in grinding corn or other animal food products and are also useful for other grinding or shredding operations. However, known devices of this type do not include the specific details of the invention disclosed herein.

SUMMARY OF THE INVENTION

An object of the present invention is to provide a compost shredder provided with a shredding cylinder having a plurality of circumferentially spaced grate bars extending longitudinally along the inner surface thereof for coaction with a plurality of hammers pivotally mounted on a high speed rotary shaft in which the hammers have a straight shank and a twisted end portion moving in a path closely adjacent the grate bars to shred compost in the shredding cylinder and to move the compost longitudinally in the cylinder in a spiral path.

Another object of the invention is to provide a compost shredder in accordance with the preceding object in which the cylinder includes an inlet at one end of the cylinder for gravity flow of compost into the cylinder adjacent one end thereof, said cylinder including an outlet for shredded compost at the lower portion thereof adjacent the opposite end of the cylinder for discharge into a conveyor.

A further object of the invention is to provide a compost shredder in accordance with the preceding objects in which the outlet opening is provided with a slide gate for adjusting the size characteristics of the outlet opening to enable the flow of compost from the shredder to be adjusted thereby controlling the shredding characteristics of the compost shredder.

Still another object of the invention is to provide a compost shredder in accordance with the preceding objects in which the structure of the shredder is rugged and dependable, effective in shredding compost and similar material, easy to repair and maintain and effective to shred compost or similar material to enable the material to be more easily recycled.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
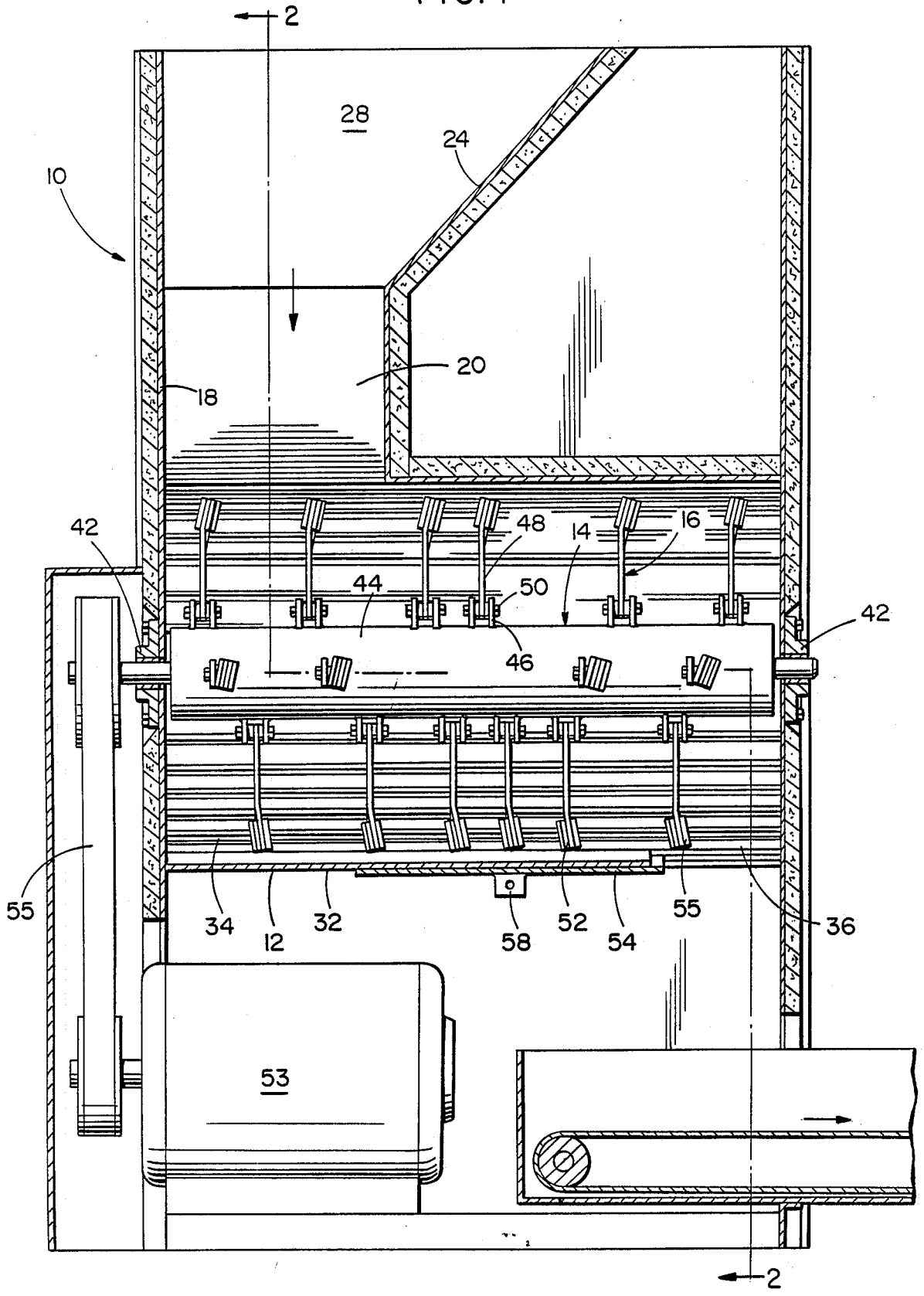
FIG. 1 is a side elevational view of the compost shredder with the shredding cylinder and associated structure being illustrated in section.
Figure 2:
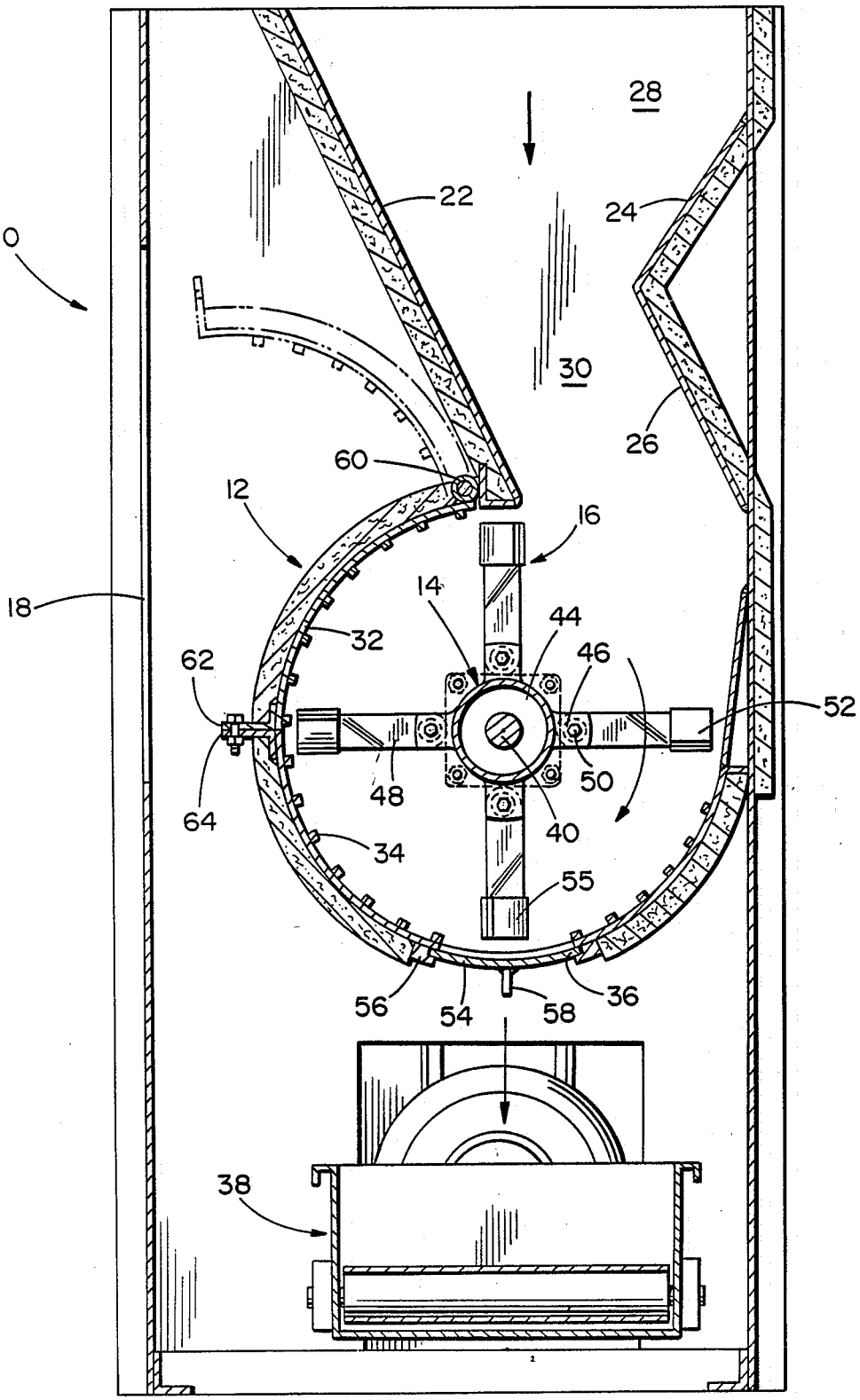
FIG. 2 is a vertical sectional view of the compost shredder illustrating the relationship of the components of the invention.

Referring now specifically to the drawings, the compost shredder of the present invention is generally designated by reference numeral 10 and includes a shredding cylinder generally designated by the numeral 12 as one of the major components thereof in which a drum 14 is mounted with the drum including a plurality of hammers 16 thereon. The cylinder 12 is stationarily supported by a framework or end walls 18 and the upper portion thereof is provided with an inlet opening 20 at one end thereof having inclined guide walls 22, 24 and 26 forming a hopper 28 and inlet chute 30 which extends to and communicates with the inlet 20 as illustrated in FIG. 2. The inlet 20 and associated walls are located at one end of the cylinder 12 so that compost or other material placed in the hopper 28 will enter the inlet 20 into the cylinder 12.

The cylinder 12 is a rigid cylindrical member 32 having a plurality of longitudinally extending, circumferentially spaced grate bars 34 rigidly affixed to the inner surface thereof with the bars 34 being equally spaced and extending throughout the surface area of the cylinder 12 except for the inlet 20 on the upper portion of the cylinder at one end thereof and an outlet opening 36 at the opposite end of the cylinder and on the lower portion thereof for discharging shredded compost or other material onto an off bearing conveyor 38 which is of conventional construction and may be a belt-type conveyor, auger conveyor or the like for conveying the shredded compost to the next stage of recycling.

The drum 14 includes a shaft 40 supported by bearings 42 in the frame or walls 18 with a cylindrical drum 44 being rigidly affixed to the shaft 40 and provided with radially extending, circumferentially spaced pairs of lugs 46 thereon. Each pair of lugs supports a hammer 16 which is in the form of a generally straight shank 48 of rectangular cross-sectional configuration for positioning between the lugs 46 and removably secured thereto by a pivot bolt or fastener 50 which enables the hammer 16 to pivot in relation to the drum 14 and cylinder 12 during rotation. Each of the shanks 48 has an outer end portion 52 which is twisted in relation to the shank 48. The twisted ends 52 will cause the compost material to move longitudinally in the cylinder and also cause the material to move in a spiral path around the drum 14 as it is being driven by an electric motor 54 connected to the shaft 40 by a belt-drive assembly 56 or by any other driving connection with the motor 54 being connected to a source of suitable electrical energy and positioned interiorly of the wall 18 and supported in any conventional manner. The motor could be a direct drive and could be a hydraulic motor or other prime mover.

The outer ends of the hammers 16 pass closely adjacent the inner surface of the grate bars 34 and compost or other material deposited into the interior of the cylinder will be impacted by the twisted ends 52 of the hammer shanks 48 thereby shredding and comminuting compost or other similar material.

The outlet 36 includes a slide plate 54 positioned against the exterior of the cylinder 32 and slidably supported by longitudinally extending slides 56 secured to the cylindrical member 32 along each side of the opening 36 to slidably receive the door 54. The door 54 includes a lug 58 to which an operating handle or rod can be attached to enable remote opening and closing movement of the door 54 in relation to the discharge opening 36 thereby determining the size of shredded compost material or other material discharged from the outlet opening 36 onto the conveyor 38.

In order to reduce noise produced by the high speed shredder, the walls 18, 22, 24, 26 and the cylindrical member 32 may be provided with acoustical insulation. Also, the upper longitudinal portion of the cylindrical member 32 may be in the form of a door having a supporting hinge 60 along its upper edge adjacent the inlet 20 and its lower edge has a flange 62 projecting outwardly therefrom to engage and be secured to a flange 64 on a stationary portion of the shredding cylinder by the use of bolts or other fasteners which will provide access to the interior of the cylinder to enable replacement of the hammers 16 and, when necessary, enable replacement of the grate bars.

The straight shanks 48 with the twisted ends 52 not only shred the material but also move it spirally from the inlet 20 to the outlet 36 with the control gate or door 54 determining the number of revolutions the compost material will move during its movement between the inlet and outlet thereby varying the size of shredded material produced by the shredder of this invention.

The ends of the shanks 48 are provided with attachments 55 of hardened steel or the like to increase the impact characteristics and wear capabilities of the shanks. However, in some instances, the attachments 55 can be omitted and the twisted ends 52 formed as a generally straight portion of the shanks 48 although there will always be at least a slight twist to move the material spirally toward outlet 36.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A compost shredder comprising an elongated cylinder, means supporting the cylinder in substantially horizontal position, an inlet at the top and adjacent one end of the cylinder, an outlet adjacent the bottom at the opposite end of the cylinder, a rotatable member mounted for rotation within the cylinder with the axis of rotation of the rotatable member being coincidental to the central axis of the cylinder, means driving said rotatable member, a plurality of hammer members extending radially from the rotatable member toward the interior of the cylinder, means pivotally mounting the inner ends of the hammer members to the rotatable member for pivotal movement about axes parallel to the rotational axis of the rotatable member, said cylinder including a plurality of circumferentially spaced, longitudinally extending grate bars fixedly mounted on the inner surface thereof, the outer ends of the hammer members being disposed closely adjacent the grate bars to shred material placed in the cylinder, said hammer members having an angulated portion inclined in relation to the axis of rotation of the rotatable member to move material being shredded in a spiral path from the end of the cylinder having the inlet toward the end of the cylinder having the outlet.

2. The structure as defined in claim 1 together with a door overlying the outlet, means slidably mounting the door along the outer surface of the cylinder for axial reciprocation to open and close the outlet for varying the rate of discharge of shredded material from the cylinder to control the length of time the material being shredded is retained in the cylinder.

3. The structure as defined in claim 2 wherein said cylinder includes a peripheral access panel forming a portion of the cylinder, means removably securing the access panel in alignment with the remainder of the cylinder to provide access to the interior of the cylinder and the hammer members for repair and replacement of components.

4. The structure as defined in claim 2 wherein each of said hammer members includes an inner shank portion that is longitudinally straight and provided with a rectangular, cross-sectional configuration, the outer end portion of the shank being twisted about the longitudinal axis of the hammer member with all of the hammer members having the outer end portion twisted in the same direction to move material being shredded longitudinally in the same cylinder.

5. A compost shredder comprising an elongated cylinder, means supporting the cylinder in substantially horizontal position, an inlet at the top and adjacent one end of the cylinder, an outlet adjacent the bottom at the opposite end of the cylinder, a rotatable member mounted for rotation within the cylinder with the axis of rotation of the rotatable member being coincidental to the central axis of the cylinder, means driving said rotatable member, a plurality of hammer members extending radially from the rotatable member toward the interior of the cylinder, means pivotally mounting the inner ends of the hammer members to the rotatable member for pivotal movement about axes parallel to the rotational axis of the rotatable member, said cylinder including a plurality of circumferentially spaced, longitudinally extending grate bars fixedly mounted on the inner surface thereof, the outer ends of the hammer members being disposed closely adjacent the grate bars to shred material placed in the cylinder, said hammer members having an angulated portion to move material being shredded in a spiral path from the end of the cylinder having the inlet toward the end of the cylinder having the outlet, each of said hammer members including an inner shank portion that is longitudinally straight and provided with a rectangular, cross-sectional configuration, the outer end portion of the shank being twisted about the longitudinal axis of the hammer member with all of the hammer members having the outer end portion twisted in the same direction to move material being shredded longitudinally in the cylinder.

6. The structure as defined in claim 5 wherein the outer end portion of each shank is laterally thicker than the inner end portion to provide impact engagement with material being shredded.

7. The structure as defined in claim 6 wherein said means mounting the hammer members on the rotatable member includes a pair of lugs rigid with the rotatable member and receiving the inner end of the shank therebetween and a fastening member extending through the lugs and inner end of the shank.

8. The structure as defined in claim 5 together with a door overlying the outlet, means slidably mounting the door along the outer surface of the cylinder for axial reciprocation to open and close the outlet for varying the rate of discharge of shredded material from the cylinder to control the length of time the material being shredded is retained in the cylinder.

9. A compost shredder comprising an elongated cylinder, means supporting the cylinder in substantially horizontal position, an inlet at the top and adjacent one end of the cylinder, an outlet adjacent the bottom at the opposite end of the cylinder, a rotatable member mounted for rotation within the cylinder with the axis of rotation of the rotatable member being coincidental to the central axis of the cylinder, means driving said rotatable member, a plurality of hammer members extending radially from the rotatable member toward the interior of the cylinder, means pivotally mounting the inner ends of the hammer members to the rotatable member for pivotal movement about axes parallel to the rotational axis of the rotatable member, said cylinder including a plurality of circumferentially spaced, longitudinally extending grate bars fixedly mounted on the inner surface thereof, the outer ends of the hammer members being disposed closely adjacent the grate bars to shred material placed in the cylinder, said hammer members having an angulated portion to move material being shredded in a spiral path from the end of the cylinder having the inlet toward the end of the cylinder having the outlet, said cylinder including a peripheral access panel forming a portion of the cylinder, means removably securing the access panel in alignment with the remainder of the cylinder to provide access to the interior of the cylinder and the hammer members including an inner shank portion that is longitudinally straight and provided with a rectangular, cross-sectional configuration, the outer end portion of the shank being twisted about the longitudinal axis of the hammer member with all of the hammer members having the outer end portion twisted in the same direction to move material being shredded longitudinally in the same cylinder.

10. The structure as defined in claim 9 together with conveying means underlying the outlet for conveying shredded material to a point of further use.

11. The structure as defined in claim 10 together with an inlet chute communicated with the inlet in the cylinder and extending upwardly therefrom to form a hopper for receiving material to be shredded.

12. The structure as defined in claim 11 wherein the exterior of said cylinder and chute are provided with acoustic insulating material to reduce noise when the rotatable member is driven at high speeds, said chute being angulated to preclude the hammer members from throwing material upwardly through the inlet.

13. A compost shredder comprising an elongated cylinder, means supporting the cylinder in substantially horizontal position, an inlet at the top and adjacent one end of the cylinder, an outlet adjacent the bottom at the opposite end of the cylinder, a rotatable member mounted for rotation within the cylinder with the axis of rotation of the rotatable member being coincidental to the central axis of the cylinder, means driving said rotatable member, a plurality of hammer members extending radially from the rotatable member toward the interior of the cylinder, means pivotally mounting the inner ends of the hammer members to the rotatable member for pivotal movement about axes parallel to the rotational axis of the rotatable member, said cylinder including a plurality of circumferentially spaced, longitudinally extending grate bars fixedly mounted on the inner surface thereof, the outer ends of the hammer members being disposed closely adjacent the grate bars to shred material placed in the cylinder, a door overlying the outlet, means slidably mounting the door along the outer surface of the cylinder for axial reciprocation to open and close the outlet for varying the rate of discharge of shredded material from the cylinder to control the length of time the material being shredded is retained in the cylinder.

14. The structure as defined in claim 13 wherein each of said hammer members includes an inner shank portion that is longitudinally straight and provided with a rectangular, cross-sectional configuration, the outer end portion of the shank being twisted about the longitudinal axis of the hammer member with all of the hammer members having the outer end portion twisted in the same direction to move material being shredded longitudinally in the cylinder.

* * * * *